US006112421A

United States Patent [19]

Greene

[11] Patent Number: 6,112,421

[45] **Date of Patent: *Sep. 5, 2000**

[54] MULTI-USE RAZOR

[76] Inventor: Todd M. Greene, 529 Montana Ave., #7, Santa Monica, Calif. 90403

[ * ] Notice: This patent is subject to a terminal disclaimer.

[21] Appl. No.: 09/292,280

[22] Filed: Apr. 15, 1999

Related U.S. Application Data

[63] Continuation-in-part of application No. 09/061,739, Apr. 16, 1998, Pat. No. 6,018,877.

[51] Int. Cl.[7] ..... B26B 21/52

[52] U.S. Cl. ..... 30/526; 30/537; 30/298

[58] Field of Search ..... 30/357, 34.05, 30/296.1, 298, 232, 291, 527, 526

[56] References Cited

U.S. PATENT DOCUMENTS

| | | | |
|---|---|---|---|
| D. 146,759 | 5/1947 | Brown | D22/3 |
| D. 304,773 | 11/1989 | Beuchat | D28/46 |
| 1,201,317 | 10/1916 | Lishawa . | |
| 1,418,191 | 5/1922 | McGarvey . | |
| 2,534,861 | 12/1950 | Foltis | 30/47 |
| 2,720,696 | 10/1955 | Wadsworth | 30/41.5 |
| 2,918,685 | 12/1959 | Sundstrom | 15/4 |
| 3,314,146 | 4/1967 | Cooksey | 30/43.6 |
| 4,026,016 | 5/1977 | Nissen | 30/47 |
| 4,094,063 | 6/1978 | Trotta | 30/527 X |
| 4,167,059 | 9/1979 | Iten | 30/32 |
| 5,038,479 | 8/1991 | Davis | 30/298 |
| 5,050,301 | 9/1991 | Apprill, Jr. | 30/87 |
| 5,060,385 | 10/1991 | Newsom | 30/287 |
| 5,129,157 | 7/1992 | Wood | 30/85 |
| 5,157,835 | 10/1992 | Lazarchik et al. | 30/85 |
| 5,167,069 | 12/1992 | Quinn | 30/527 |
| 5,340,067 | 8/1994 | Martin et al. | 248/118.5 |
| 5,341,535 | 8/1994 | O'Brien | 15/22.4 |
| 5,497,551 | 3/1996 | Apprille, Jr. | 30/85 |
| 5,555,892 | 9/1996 | Tipton | 128/757 |
| 5,911,480 | 6/1999 | Morgan | 30/526 X |
| 6,018,877 | 2/2000 | Greene | 30/526 |

FOREIGN PATENT DOCUMENTS

| | | | |
|---|---|---|---|
| 2636558 | 3/1990 | France | 30/FOR 1 |
| 2701123 | 7/1978 | Germany | 30/FOR 105 |
| 2265105 | 9/1993 | United Kingdom . | |

*Primary Examiner*—M. Rachuba
*Assistant Examiner*—Dominic Troiano
*Attorney, Agent, or Firm*—Cislo & Thomas LLP

[57] ABSTRACT

A razor that is configured for selectively shaving the head or face and wherein a body member has an upstanding finger engaging means whereby a body member may be retained in relationship to the fingers of the user, and which retains in releasable or integral fashion and in pivotable or non-pivotable relationship a razor blade, and wherein the razor may be selectively used to shave the head of the user or when taken off the finger, may be used to shave the face of the user in conventional fashion.

12 Claims, 5 Drawing Sheets

MULTI-USE RAZOR

CROSS-REFERENCES TO RELATED APPLICATIONS

This application is a continuation-in-part of application Ser. No. 09/061,739, now U.S. Pat. No. 6,018,877, filed Apr. 16, 1998 and entitled VERSATILE FINGER RETAINED RAZOR, the content of which is hereby incorporated by reference.

BACKGROUND OF THE INVENTION

1. Field of the Invention

This invention relates generally to razors of the type that are easily held by the hand or retained in relation thereto, and are particularly useful for the shaving of heads and versatile enough to be held by the hand, in the usual shaving position, to shave the face.

In recent times, the bald pates of both males and females have become fashionable. The usual shaving means available for shaving heads, such as electric razors, safety razors, and the like, have not been entirely suitable inasmuch as holding these razors is somewhat awkward when one goes to shave an awkward area or one that is particularly out of line of sight of the user.

In shaving the head, it is necessary to have what may be considered a "feel" for or proprioception for the surface to be shaved and the closeness of the shave to be delivered, and holding a typical or conventional razor, as by a handle, does not fully meet the needs because of the awkwardness of shaving an area not readily seen as, for example, the back of the head.

It should therefore be appreciated that there is a need for a shaving device that is simple in use, economically fabricated, relatively low in cost, and which has the uniqueness of being positioned on a finger, for example, of the user so that contiguous fingers may give the user a reference point and a feeling of comfort when shaving portions of the head that are particularly difficult to see or reach. Having such a razor that can also be used in a conventional sense to shave the face would also be desirable.

2. Description of the Related Art

While the prior art has taught the use of various types of razor blades, none of the prior art currently known teaches the use of a finger retained razor, which may or may not be wholly disposable, and wherein the body member carrying a razor blade in either releasable fashion (pivotable or non-pivotable) or integrally secured thereto, may be easily used to shave the head of the user and also used for shaving the face by merely removing and repointing the entry edge of the razor blade and in one embodiment, extending the extensible handle.

Prior art devices as indicated have been awkward in use having handles or large body members holding the razor blade, such that one loses the "feel" when shaving a sensitive area, such as the head, especially where portions of the head may not be readily seen.

The known prior art consists of the following:

| PAT. NO. | INVENTOR | ISSUED |
|---|---|---|
| Des. 146,759 | BROWN | MAY 13, 1947 |
| Des. 304,773 | BEUCHAT | NOV 21, 1989 |

-continued

| PAT. NO. | INVENTOR | ISSUED |
|---|---|---|
| 1,418,191 | MC GARVEY | MAY 30, 1922 |
| 2,534,861 | FOLTIS | DEC. 19, 1950 |
| 2,918,685 | SUNDSTROM | DEC 29, 1959 |
| 4,167,059 | ITEN | SEP 11, 1979 |
| 5,050,301 | APPRILLE, JR. | SEP 24, 1991 |
| 5,129,157 | WOOD | JUL 14, 1992 |
| 5,157,835 | LAZARCHIK | OCT 27, 1992 |
| 5,340,067 | MARTIN ET AL. | AUG 23, 1994 |
| 5,341,535 | O'BRIEN | AUG 30, 1994 |
| 5,497,551 | APPRILLE, JR. | MAR 12, 1996 |
| 5,555,892 | TIPTON | SEP 17, 1996 |

DISCLOSURE OF THE INVENTION

The invention relates to a razor for selectively shaving the head or face and has a body member having a finger retaining means by which the razor may be manipulated for shaving the head. The underside of the body member is adapted to retain a razor blade in either releasable and replaceable fashion or is integral therewith so as to make the razor wholly disposable. Additionally, the razor component may be pivotally or non-pivotally mounted. At least one edge of the razor blade is a cutting edge which is rearwardly or forwardly disposed relative to the front of the body member depending on desired uses.

It is an object of the invention to provide a compact, easily used, easily fabricated razor, particularly for shaving the head.

It is another important object of the invention to provide a razor particularly suitable for shaving the head and, alternately, being configured so as to allow the use thereof, in a conventional sense, to shave the face of the user.

It is still another important object of the invention to provide a low cost, easily manufactured, easily used razor which may be wholly disposable or, alternately, may have a razor blade held in releasable fashion for replacement of the blade, for repeated use of the razor.

It is still another more specific object of the invention to provide a finger held razor which is disposed on the finger for example, in one embodiment, of the user and which is configured for use in the palm or under hand use of the razor device.

These and other important objects of the invention become more readily apparent when considering the hereinafter following commentary taken in conjunction with the drawings.

The present invention provides an easily manufactured, easy to use, slip-resistant designed razor, particularly suitable for shaving the head, which may be retained in a palm-like position for ease of shaving the head and when taken from beneath the palm, it may be held in a conventional sense to shave the face in a conventional manner. In an alternate embodiment, the extension of a telescopically retained handle allows for holding the razor in a conventional sense.

In particular, and for purposes of example only, the invention provides a razor for selectively shaving the head or face of the user comprising a body member, which may be formed of plastic having at least front, upper rear, and bottom sides, wherein the upper side has an upstanding finger engaging means by which the body member may be retained in association with the hand of the user. In one embodiment, the finger-retaining or engaging means, may be an upstanding closed or open ring which may or not be adjustable, and which slips over the finger of the user so that the razor is retained in the underside or palm position to thereby allow ease of use for shaving the head. In another embodiment, a telescopically retained handle is employed.

The bottom side of the body member is adapted to retain a thin razor blade thereon in releasable fashion, either in pivotable or non-pivotable relationship. In another embodiment the razor blade may be rigidly secured and molded in one piece thereby making the razor of the invention wholly disposable, and wherein the razor blade has at least one cutting edge mounted in retained relationship with the body member. The at least one cutting edge is capable of being disposed rearwardly or forwardly relative to the front side of the body member retaining the thin razor blade for ease of shaving and desired mode of use.

BRIEF DESCRIPTION OF THE DRAWINGS

The following drawings illustrate the preferred embodiment of the invention. In such drawings.

DESCRIPTION OF THE PREFERRED EMBODIMENT(S)

Figure 1:
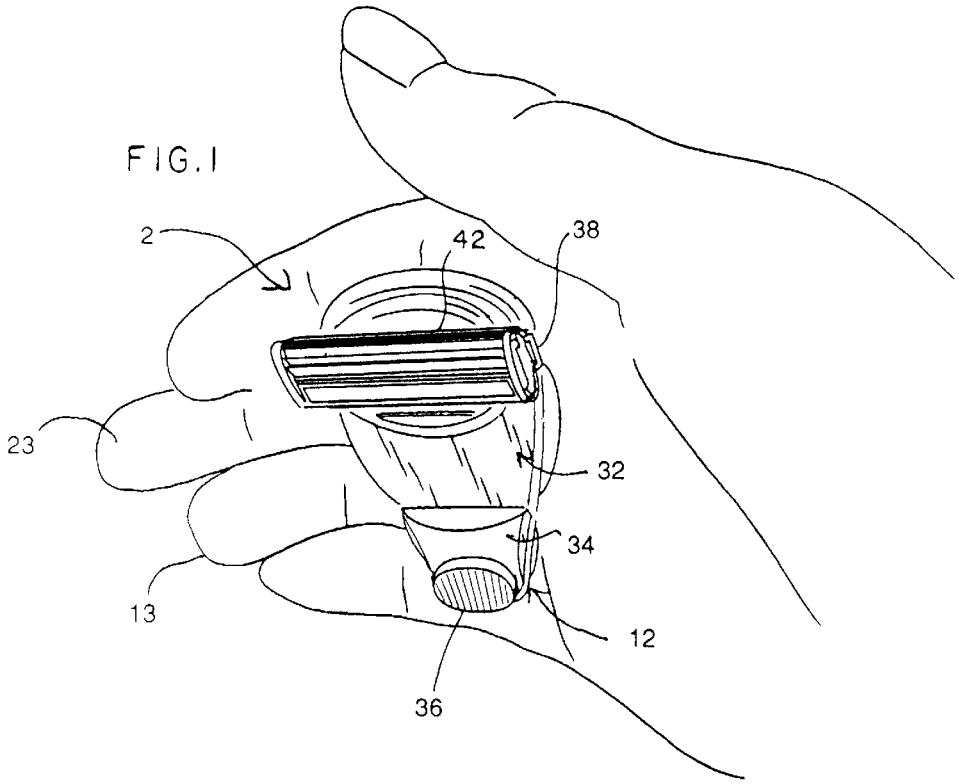
FIG. 1 is a perspective view showing the razor of the invention being held in conjunction with the hand of the user.
Figure 2:
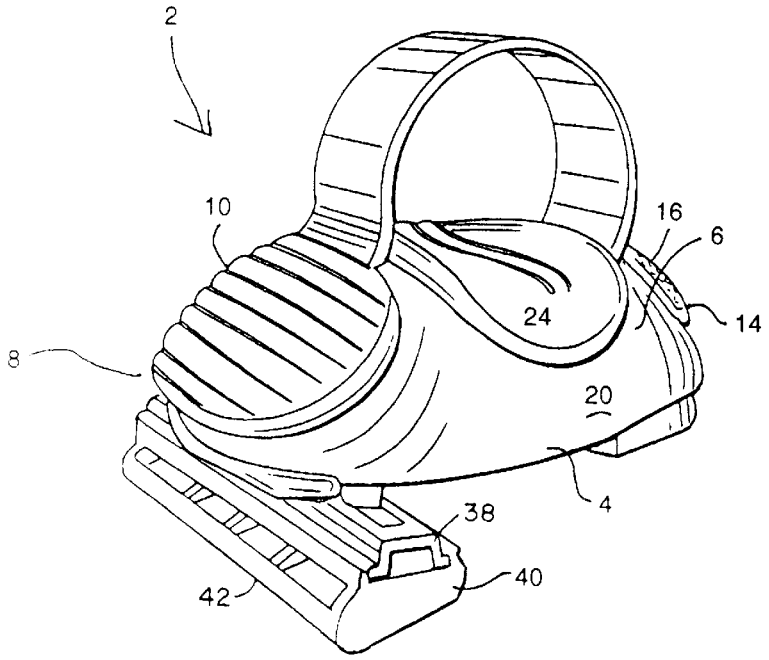
FIG. 2 is a perspective view of the razor of the invention.
Figure 3:
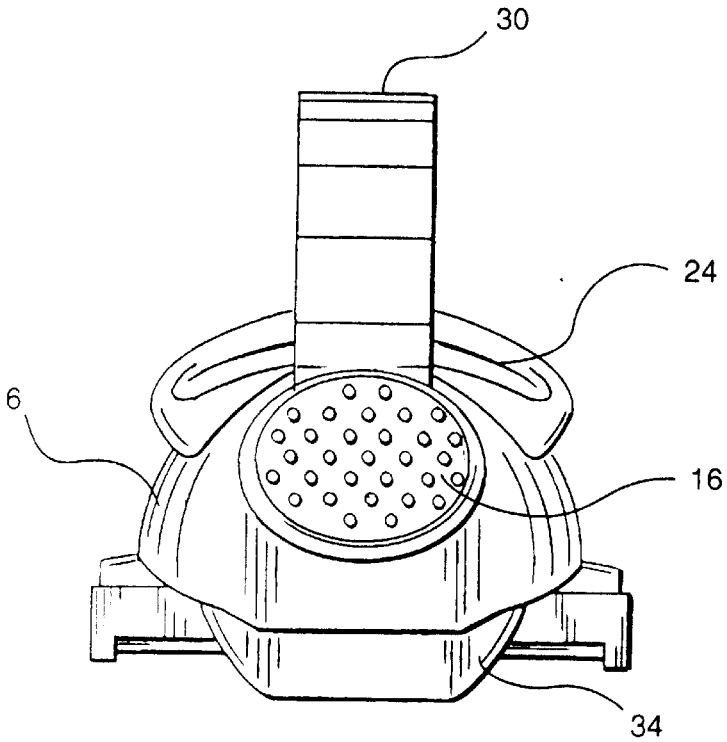
FIG. 3 is a rear view of the razor of the invention.
Figure 4:
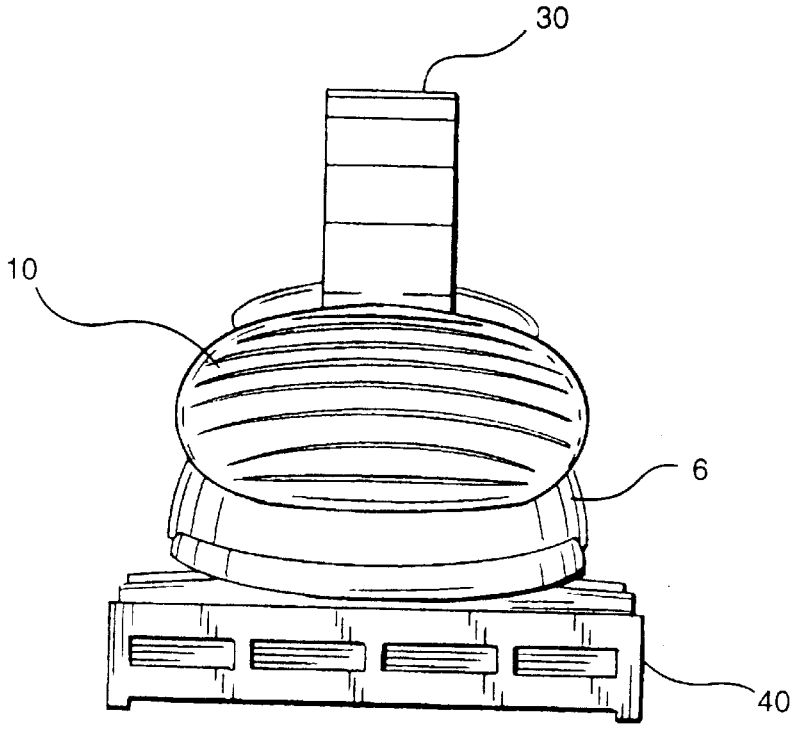
FIG. 4 is a front view of the razor of the invention showing the razor blade mounting and more detail of the razor of the invention.
Figure 5:
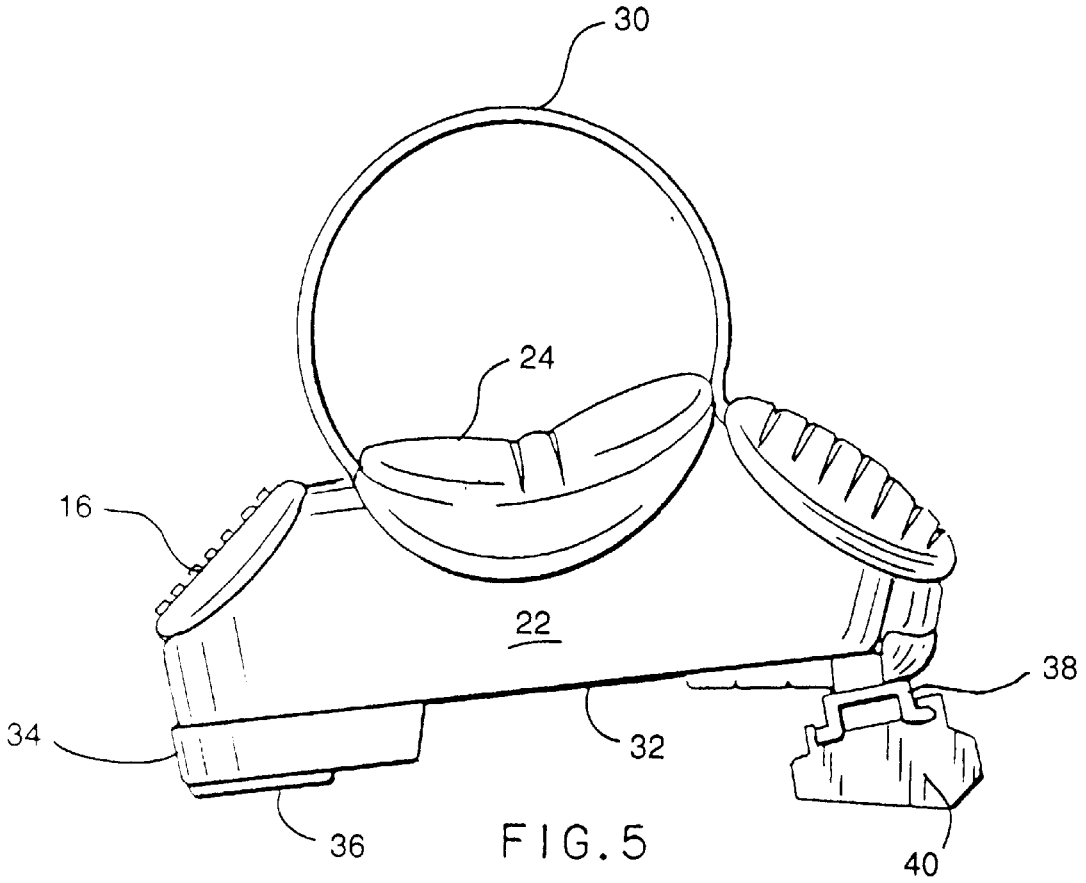
FIG. 5 is a side view of the razor of the invention showing more detail of the razor.

In referring to the figures of drawings wherein like numerals of reference designate like elements throughout, it will be seen that one embodiment of the invention comprises razor 2 having a body member 4, in this particular instance of molded plastic and being of unitary configuration, having what may be considered a tear drop shape, wherein the body member 4 has an upper surface 6, a front surface 8, which is pad 10 having ridges for ease of friction retention of, for example, the pointer finger 9 of the user. Body member 4 has a tapering rear portion 12 with a rear pad 14, having a plurality of raised dimples 16, again for enabling friction fit retention by means of the undersurface of the third finger 13.

The body member 6 has side surfaces 20 and 22 blending into upper finger saddle portion 24, which is adapted to receive the second finger 23 which is encompassed by ring element 30 and, in this particular instance being of metal but which may also be of unitary molded plastic in either partially open or fully closed ring configuration.

The undersurface 32 of body member 6 has a rearward pad 34 of sufficient depth so as to provide a point contact surface 36 when the razor 2 engages the head of the user. Positioned on the undersurface 32 is razor holding member 38 which is configured to releasably retain razor blade element 40 in relation thereto, wherein razor element 40 is of the typical disposable type having cutting edge 42 and which may be rearwardly or forwardly disposed relative to the front 8 of body member 6. Thus, razor blade element 40 may be slidably disposed onto razor holding member 38 and wherein, depending upon the orientation of razor blade element 40, the cutting edge 42 may face forward or rearward for either push or draw shaving.

Figure 6:
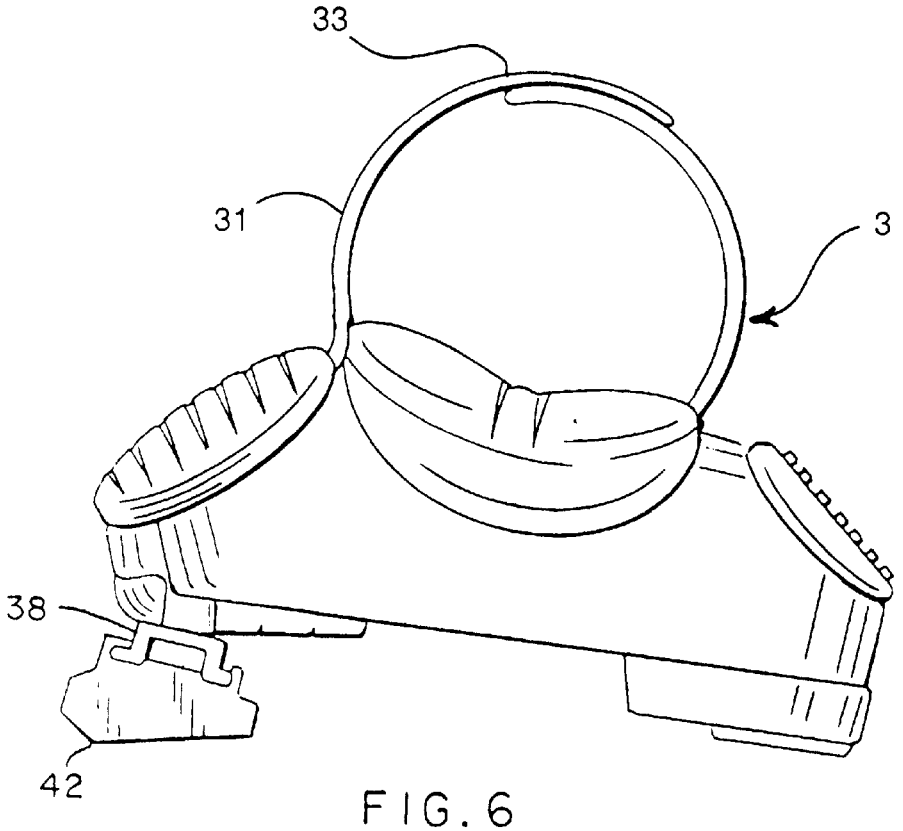
FIG. 6 is a view similar to FIG. 5, but showing a different elevational view and illustrating the ring element being adjustable in nature.

Referring to FIG. 6 the razor 3 is of the same construction as the razor 2, the only exception being in the ring portion 31, which in this instance is made up of ring portions 33 and 35 which, in this particular instance, may be made of metal or some other ductile or pliable material such that the ring portion 31 is adjustable to accommodate the size of the finger of the user of the razor 3.

Figure 7:
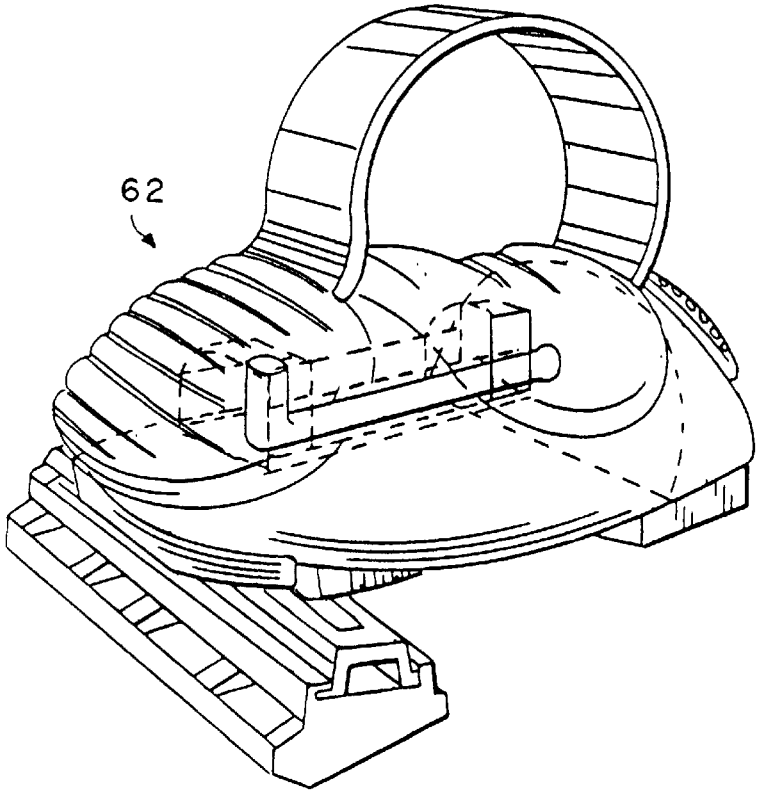
FIG. 7 is a perspective view of still another embodiment of the invention.
Figure 8:
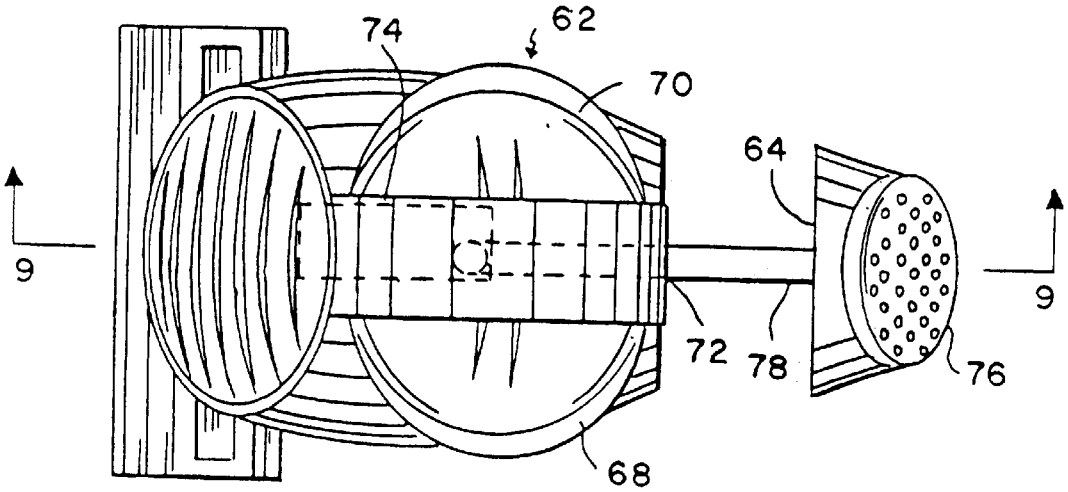
FIG. 8 is a top view of the razor shown in FIG. 7, showing the telescopically retained handle in the extended position.
Figure 9:
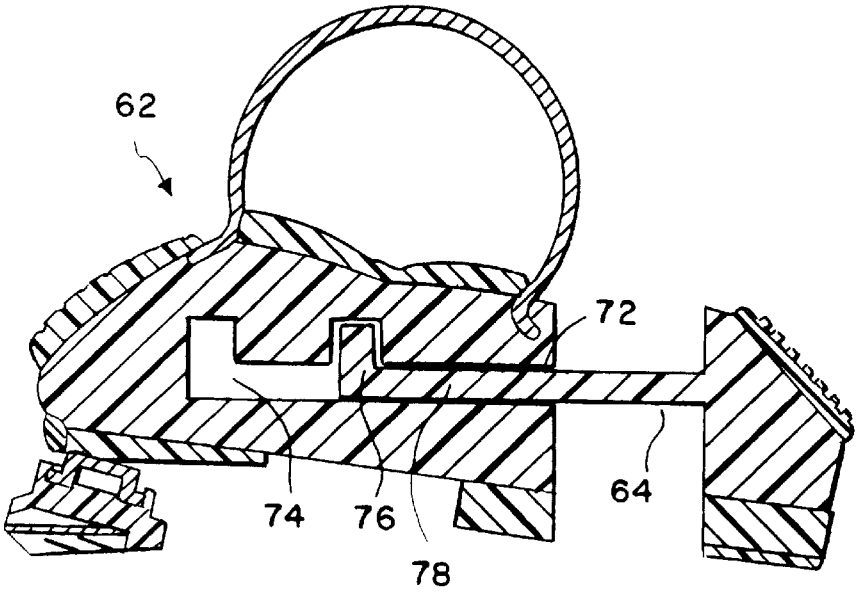
FIG. 9 is a side view of the razor shown in FIG. 8.

Referring to FIGS. 7, 8 and 9, the embodiment of the invention razor 62 is illustrated having an extensible handle member 64 which is telescopically received into the body of razor 62 as will be described.

In this particular embodiment, the razor 62 is of two-part molded construction with the mold part line not being shown and wherein each of the halves 68 and 70 of razor 62 are molded with channel 72 and main bore 74 such that the extensible handle 64 has an end portion 76 and a stem or rod portion 78 captively retained in the channel 72 and being telescopically received therein. To retract the telescopically positioned handle 64, one merely pushes on the end 76 until it hits the end of bore 74 and then rotates the handle 90° so that the handle 64 becomes fully enclosed or retractable into the body of razor 62 as shown in FIG. 7. Obviously other means of having a retractable handle portion, for further ease and comfort of using the razor 62 of the invention in conventional fashion, as for shaving a face may be employed in addition to that heretofore described.

Figure 10:
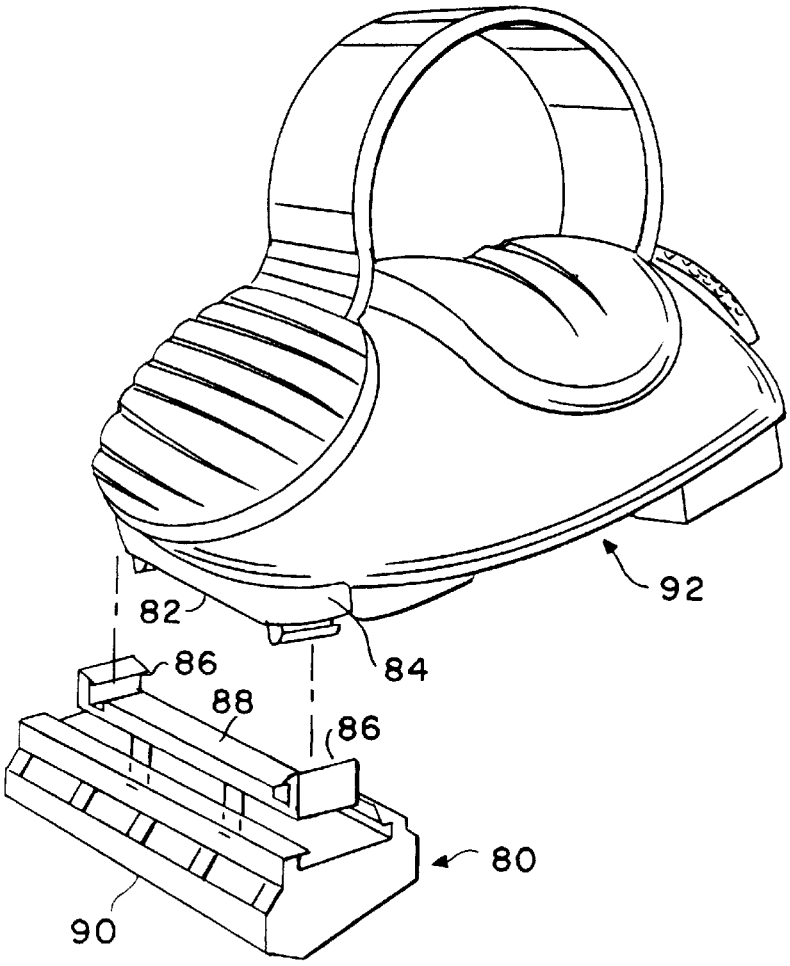
FIG. 10 is an exploded schematic view showing a pivotally mounted blade cartridge in relation to one razor embodiment of the invention.

Referring now to FIG. 10, there is shown a blade cartridge 80 adapted to fit into the retaining groove 82 of blade cartridge holder 84. In this particular instance, the cartridge 80 has opposed spring loaded, clip on like pin members 86 with the central portion 88 pivotally mounting blade component 90 such that when the cartridge 80 is associated with the cartridge holder 84, the same is pivotally mounted relative to the secured cartridge holder 84 of razor 92.

In the embodiments shown for razors 2, 3, 62 and 92 the same may be made totally of one or two piece molded plastic with the razor blade being either rigidly secured in nonreleasable fashion to thereby make the razor wholly disposable or may be fashioned to releasably receive conventional razor blade cartridge 40 in pivotable or non-pivotable relationship. Suitable plastics, such as those currently used for disposable safety razors, will suffice for the razors of this invention.

However, in the embodiments shown in figures, it is intended that the razor element be releasably retained as to be replaceable in the usual, conventional fashion with respect to safety razors having replaceable blade elements, and it is intended in the practice of the invention using the razor of the invention that the blade be easily replaceable.

In use, the razor 2, 3, 62 or 92 is positioned as shown in FIG. 1 and held in finger engaging relationship to the underside or palm portion of the hand and after suitable lather or soap has been placed on the scalp, one merely passes the hand held razor 2, 3, 62 or 92 over the pate of the head of the user thereby shaving in push or pull stroke fashion as is conventional.

It will be noted that the pads 10 and 16 are engaged by the underside of the fingers, as can clearly be seen in FIG. 1. The concave configuration of the upper finger saddle portion. 24 makes the razor 2 or 3 fit comfortably in association with the hand of the user. The under pad 36 acts as a contact point or surface so that when the razor 2 or 3 is brought across the lathered head, the cutting edge of the razor element 40, more specifically 42, forms a two point contact for ease of guiding the razor 2 or 3 across the pate to be shaved. While under pad 36 is shown as an integral component with body member 4, it may also be adjustable by way of screw securement or the like to raise or lower the razor 2 for desired use.

Obviously, the configuration of the body member 4 is such that the razor 2 or 3 may be taken off the finger as shown in FIG. 1 and held by the sides 20 and 22 by the thumb and forefinger of the hand of the user to shave the face in conventional fashion should one so desire. Obviously, in like fashion the extensible handle 64 may be withdrawn to provide ease of shaving in this manner and then pushed back into place so that the razor 62 may be used as previously described for shaving the head.

Thus, there has been disclosed in illustrative form only, a razor having a body for being retained in association with the fingers of a hand of the user and which is uniquely configured for shaving the head and yet may also be used for shaving the face. While a specific configuration for the razors have been disclosed, those of ordinary skill in the art will at once see that various modifications and changes can be made all without departing from the spirit and scope of the invention and all such modifications and changes are intended to be covered by the appended claims.

What is claimed is:

1. A razor for selectively shaving the head and face of the user comprising the combination of:

a body member of molded plastic having a tapered configuration and having at least front, upper, rear and bottom sides, said upper side having an upstanding finger engaging means by which said body member may be retained in association with the hand of the user thereof;

said bottom side of said body member being adapted to retain a razor blade thereon; and a thin razor blade having at least one cutting edge mounted in retained relationship with said body member;

said at least one cutting edge being selectively disposed relative to said front side of said body member.

2. The razor in accordance with claim 1, wherein said body member comprises two components, one rearward component comprising an extensible handle that is telescopically received within the other component.

3. The razor, in accordance with claim 1, wherein said body member is wider at the front than the rear and is configured to fit within the underside of the fingers of the hand of the user.

4. The razor, in accordance with claim 3, wherein said body member has an enlarged front configuration tapering rearwardly to said rear side.

5. The razor, in accordance with claim 1, which includes a razor blade holding means on said bottom side of said body member, and said razor blade is releasably retained in said razor blade holding means.

6. The razor, in accordance with claim 5, wherein said upstanding finger engaging means comprises a ring-like member.

7. The razor, in accordance with claim 6, wherein said ring-like member is adjustable in size to accommodate the finger diameter of the user thereof.

8. The razor, in accordance with claim 6, wherein said body member additionally has lateral sides adapted to be grasped by the hand of the user, whereby said razor may be used for face shaving.

9. The razor, in accordance with claim 8, wherein said body member is of integral molded plastic.

10. The razor, in accordance with claim 9, wherein said body member has ridges in said upper side to form friction gripping surfaces for the fingers of the user of said razor.

11. The razor, in accordance with claim 10, wherein said razor is pivotally mounted.

12.A razor for selectively shaving the head and face of the user comprising the combination of:

a body member of molded plastic having a tapered configuration and having at least front, upper, rear and bottom sides, said upper side having an upstanding finger engaging means by which said body member may be retained in association with the underside of the hand of the user thereof; said body member being broadest at said front side and said bottom side of said body member being adapted to retain a razor blade thereon; and a thin razor blade having at least one cutting edge mounted in retained relationship with said body member; said at least one cutting edge being selectively disposed relative to said front side of said body member and said upstanding finger engaging means being narrower than the widest part of said body member.

* * * * *